US006074993A

United States Patent [19]

Waddoups et al.

[11] Patent Number: 6,074,993

[45] Date of Patent: Jun. 13, 2000

[54] LUBRICATING OIL COMPOSITION CONTAINING TWO MOLYBDENUM ADDITIVES

[75] Inventors: Malcolm Waddoups, Westfield; Rolfe J. Hartley, Cranbury, both of N.J.; Taisuke Miyoshi, Yokohama, Japan

[73] Assignee: Infineuma USA L.P., Linden, N.J.

[21] Appl. No.: 09/426,690

[22] Filed: Oct. 25, 1999

[51] Int. Cl.[7] ..... C10M 141/12

[52] U.S. Cl. ..... 508/364; 508/365; 508/372; 508/375; 508/377; 508/379

[58] Field of Search ..... 508/363, 364, 508/365, 372, 375, 377, 379

[56] References Cited

U.S. PATENT DOCUMENTS

| | | | |
|---|---|---|---|
| 5,356,547 | 10/1994 | Arai et al. | 508/364 |
| 5,665,684 | 9/1997 | Arai et al. | 508/364 |
| 5,672,572 | 9/1997 | Arai et al. | 508/364 |
| 5,888,945 | 3/1999 | Stiefel et al. | 508/363 |
| 5,895,779 | 4/1999 | Boffa | 508/364 |
| 5,906,968 | 5/1999 | Mc Connachie et al. | 508/363 |
| 6,010,987 | 1/2000 | Stiefel et al. | 508/363 |

*Primary Examiner*—Jacqueline V. Howard

[57] ABSTRACT

A lubricating oil composition exhibiting improved fuel economy and wet clutch friction properties, which comprises: (a) an oil of lubricating viscosity; (b) at least one calcium or magnesium overbased detergent; (c) an oil soluble dimeric molybdenum compound; (d) an oil soluble organic trinuclear molybdenum compound; (e) at least one zinc dihydrocarbyldithiophosphate compound, wherein the composition has a TBN of at least 3.6 from the calcium or magnesium overbased detergent, a NOACK volatility of about 15 wt. % or less, molybdenum in an amount up to about 350 ppm from the trinuclear molybdenum compound, molybdenum in an amount up to 2,000 ppm from the dimeric molybdenum compound, and phosphorus in an amount up to about 0.1 wt. % from a zinc dihydrocarbyldithiophosphate compound.

15 Claims, No Drawings

LUBRICATING OIL COMPOSITION CONTAINING TWO MOLYBDENUM ADDITIVES

The present invention relates to lubricating oil compositions. More particularly, the present invention relates to lubricating oil compositions, which exhibit improvements in fuel economy properties and excellent wet clutch friction performance when used as a universal oil.

BACKGROUND OF THE INVENTION

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil soluble molybdenum is useful as a lubricant additive. In particular, molybdenum provides enhanced fuel economy in gasoline or diesel fueled engines, including both short and long term fuel economy (i.e., fuel economy retention properties). The prior proposals typically use molybdenum at levels greater than 350 ppm up to 2,000 ppm in the oils, which contain one or more detergents, anti-wear agents, dispersants, friction modifiers, and the like.

The present inventors have found that fuel economy properties can be improved using two different types of molybdenum additives in combination with an organic friction modifier, a calcium or magnesium overbased detergent and a zinc dihydrocarbyl dithiophosphate.

SUMMARY OF THE INVENTION

The present invention concerns a lubricating oil composition which exhibits improved fuel economy and fuel economy retention properties, the composition comprising: (a) an oil of lubricating viscosity; (b) at least one overbased magnesium or calcium detergent; (c) an organic oil soluble dimeric molybdenum compound present in such amounts so as to provide up to about 2,000 ppm (weight) Mo from said dimeric compound in the composition; (d) an organic oil soluble trinuclear molybdenum compound present in such amounts so as to provide up to about 350 ppm Mo from said trinuclear compound in the composition; (e) at least one organic friction modifier; and (f) at least one zinc dihydrocarbyldithiophosphate compound. The composition has a NOACK volatility of about 15 wt. % or less, and has a TBN (total base number) of at least about 3.6 attributable to the presence of the calcium or magnesium from the overbased calcium or magnesium detergent, and contains phosphorus in an amount up to about 0.1 wt. % from the zinc dihydrocarbyldithiophosphate. The composition may be prepared by the admixture of the ingredients and such compositions are a further embodiment of this invention.

In addition, the present invention encompasses methods for improving the fuel economy properties of an internal combustion engine, the method comprising the steps of adding the lubricating oil composition of this invention to an engine and operating the engine. The oils of this invention also exhibit improved wet clutch friction properties which make them useful as universal oils.

DESCRIPTION OF THE PREFERRED EMBODIMENTS

Oil of Lubricating Viscosity

The oil of lubricating viscosity may be selected from a wide variety of base stocks including natural oils, synthetic oils, or mixtures thereof. Examples of suitable base stocks may be found in one or more of the base stock groups, or mixtures of said base stock groups, set forth in the American Petroleum Institute (API) publication "Engine Oil Licensing and Certification System", Industry Services Department, Fourteenth Edition, December 1996, Addendum 1, December 1998.

(a) Group I base stocks contain less than 90 percent saturates and/or greater than 0.03 percent sulfur and have a viscosity index greater than or equal to 80 and less than 120 using the test methods specified in Table A below.

b) Group II base stocks contain greater than or equal to 90 percent saturates and less than or equal to 0.03 percent sulfur and have a viscosity index greater than or equal to 80 and less than 120 using the test methods specified in Table A below.

c) Group III base stocks contain greater than or equal to 90 percent saturates and less than or equal to 0.03 percent sulfur and have a viscosity index greater than or equal to 120 using the test methods specified in Table A below.

d) Group IV base stocks are polyalphaolefins (PAO), a synthetic base stock.

e) Group V base stocks include all other base stocks not included in Groups I, II, III, or IV.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4292, D4927, or D3120 |

The oil of lubricating viscosity used in this invention preferably should have a viscosity index of at least 95, preferably at least 100. Preferred oils are (a) base oil blends of Group III base stocks with Group I and Group II base stocks, or (b) Group III base stocks or blends of more than one Group III base stock.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types, Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexylbenzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, din-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from C5 to C12 monocarboxylic acids and polyols and polyol ethers such as neopentyl glycol, trimethylol propane, pentaerythritol, dipentaerythritol, tripentaerythritol, etc.

Silicon-based oils such as the polyalkylpolyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy) disiloxane, poly(methyl)siloxanes, poly(methyl-phenyl) siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Calcium or Magnesium Overbased Detergent

The present invention requires the presence of at least one overbased magnesium or calcium detergent. Detergents aid in reducing deposits that build up in an engine and act as an acid neutralizer or rust inhibitor. This in turn reduces engine wear and corrosion.

The calcium or magnesium overbased detergent used in this invention may be derived from phenates, salicylates, sulfonates, or mixtures thereof, with calcium and magnesium sulfonates being particularly preferred. Preferably, the detergent will be overbased, that is the Total Base Number (TBN) will be at least 100 but usually between 100 and 500, more preferably between 150 and 450. The most preferred detergents for use in this invention is an overbased calcium or magnesium sulfonate having a TBN from 250 to 450, especially a calcium sulfonate.

The process of overbasing a metal detergent means that a stoichiometric excess of the metal is present over what is required to neutralize the anion of the salt. It is the excess metal from overbasing that has the effect of neutralizing acids which may build up.

In the present invention, overbased calcium or magnesium sulfonate detergents may be derived from the salt of an oil soluble sulfonic acid, where a mixture of an oil soluble sulfonate or alkaryl sulfonic acid is combined with calcium and heated to neutralize the sulfonic acid that is present. This forms a dispersed carbonate complex by reacting the excess calcium with carbon dioxide. The sulfonic acids typically are obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene, and chloronaphthalene. The alkylation may be carried out in the presence of a catalyst with alkylating agents having from 3 to more than 30 carbon atoms. For example, haloparaffins, olefins obtained by dehydrogenation of paraffins, or polyolefins produced from ethylene or propylene are all suitable. The alkaryl sulfonates usually contain from about 9 to about 70 or more carbon atoms, preferably from about 16 to about 50 carbon atoms per alkyl substituted aromatic moiety.

The oil soluble sulfonates are neutralized with a calcium or magnesium compound. The amount of calcium or magnesium that is used to neutralize the oil soluble sulfonate is carefully chosen with regard to the desired total base number (TBN) of the final product.

In the present invention, the amount of overbased calcium or magnesium detergents used can vary broadly, but typically will be from about 0.5 to about 5 wt. %, based on the total weight of the composition. These detergents are used in such amounts so as to provide the finished lubricating oil compositions with a TBN of at least 3.6 attributable to the overbased detergents and not from other additives which may affect TBN. For example, if 1.2 wt. % of a calcium sulfonate detergent of TBN 300 is used, the finished oil will have a TBN of 3.6 (i.e. 1.2% of 300) attributable to the overbased detergent.

Calcium or magnesium phenate or salicylate overbased detergent may be prepared using a variety of methods well known in the art.

Molybdenum Compounds

For the lubricating oil compositions of this invention, both dimeric and trimeric oil soluble molybdenum compounds are used. Examples of such oil soluble organomolybdenum compounds are the dialkyldithiocarbamates, dialkyldithiophosphates, dialkyldithiophosphinates, xanthates, thioxanthates, carboxylates and the like, and mixtures thereof. Particularly preferred are molybdenum dialkyldithiocarbamates.

The molybdenum dialkyldithiocarbamate dimer to be used as an additive in the present invention is a compound expressed by the following formula:

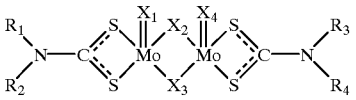

$R_1$ through $R_4$ independently denote a straight chain, branched chain or aromatic hydrocarbyl group having 1 to 24 carbon atoms; and $X_1$ through $X_4$ independently denote an oxygen atom or a sulfur atom. The four hydrocarbyl groups, $R_1$ through $R_4$, may be identical or different from one another.

The dimeric organo molybdenum additive is used in an amount so that it provides up to 2,000 ppm Mo in the lubricating oil composition, preferably 400 ppm to 2,000 ppm, such as about 700 to 900 ppm, especially about 800 ppm.

The other group of organo-molybdenum compounds useful in the lubricating compositions of this invention are trinuclear (trimeric) molybdenum compounds, especially those of the formula $MO_3S_kL_nQ_z$ and mixtures thereof wherein the L are independently selected ligands having organo groups with a sufficient number of carbon atoms to render the compound soluble in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are selected from the group consisting of

1

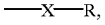

2

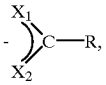

3

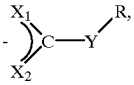

4

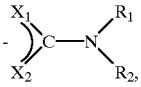

5

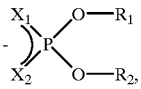

and mixtures thereof, wherein X, $X_1$, $X_2$, and Y are selected from the group consisting of oxygen and sulfur, and wherein $R_1$, $R_2$, and R are selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Importantly, the organo groups of the ligands have a sufficient number of carbon atoms to render the compound soluble in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, carboxylates, dialkyldithiocarbamate ("dtc"), and mixtures thereof. Most preferred are the dialkyldithiocarbamates. Those skilled in the art will realize that formation of the compounds of the present invention requires selection of ligands having the appropriate charge to balance the core's charge (as discussed below).

Compounds having the formula $Mo_3S_kL_nQ_z$ have cationic cores surrounded by anionic ligands, wherein the cationic cores are represented by structures such as

1

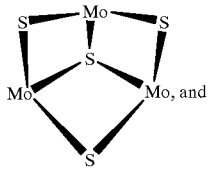

2

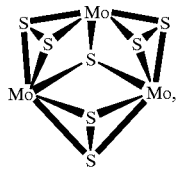

which have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate, i.e., having multiple connections to one or more cores. It is believed that oxygen and/or selenium may be substituted for sulfur in the core(s).

Oil-soluble trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble trinuclear molybdenum compounds can be formed during a reaction in the appropriate solvent(s) of a molybdenum source such as $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble trinuclear molybdenum compound. The appropriate liquid/solvent may be, for example, aqueous or organic.

The ligand chosen must have a sufficient number of carbon atoms to render the compound soluble in the lubricating composition. The term "oil-soluble" as used herein does not necessarily indicate that the compounds or additives are soluble in the oil in all proportions. It does mean that they are soluble in use, transportation, and storage.

Preferred trinuclear molybdenum compounds for use in the compositions of this invention are those of the formula $Mo_3S_7((alkyl)_2dtc)_4$ where the alkyl has about 8 to 18 carbon atoms and the alkyl being preferably a "coco" alkyl chain which is a mixture of chains of varying even numbers of carbon atoms from typically a $C_8$ to $C_{18}$ alkyl, mainly $C_{10}$, $C_{12}$ and $C_{14}$ alkyls derived from coconut oil.

The trinuclear organo molybdenum additive is used in such amounts so that it provides up to 350 ppm, preferably 10 ppm to 350 ppm Mo in the lubricating oil composition, such as about 75 to 150 ppm Mo.

A sulfurized molybdenum containing composition prepared by (i) reacting an acidic molybdenum compound and a basic nitrogen compound selected from the group consisting of succinimide, a carboxylic acid amide, a hydrocarbyl monoamine, a phosphoramide, a thiophosphoramide, a Mannich base, a dispersant viscosity index improver, or a mixture thereof, in the presence of a polar promoter, to form a molybdenum complex (ii) reacting the molybdenum complex with a sulfur containing compound, to thereby form a sulfur and molybdenum containing composition is useful in the form of either a dimeric or trinuclear Mo compound within the context of this invention. The sulfurized molybdenum containing compositions may be generally characterized as a molybdenum/sulfur complex of a basic nitrogen compound. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions.

Friction Modifiers

At least one organic oil soluble friction modifier must be incorporated in the lubricating oil composition. Typically, the friction modifier makes up about 0.02 to 2.0 wt. % of the lubricating oil composition. Preferably, from 0.05 to 1.0, more preferably from 0.1 to 0.5 wt. % of the friction modifier is used.

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acids as exemplified by glycerol oleate, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinimide acid and mixtures thereof; U.S. Pat. No. 3,879,306 which discloses N(hydroxyalkyl)alkenyl-succinimic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl)alkenyl succinimides. The disclosures of the above references are herein incorporated by reference. Examples of other friction modifiers are succinate esters, or metal salts thereof, of hydrocarbyl substituted succinic acids or anhydrides and thiobisalkanols such as described in U.S. Pat. No. 4,344,853.

Examples of nitrogen containing friction modifiers, which are a preferred category, include, but are not limited to, imidazolines, amides, amines, succinimides, alkoxylated amines, alkoxylated ether amines, amine oxides, amidoamines, nitrites, betaines, quaternary amines, imines, amine salts, amino guanadine, alkanolamides, and the like.

Such friction modifiers can contain hydrocarbyl groups that can be selected from straight chain, branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Preferred friction modifiers include amides of polyamines. Such compounds can have hydrocarbyl groups that are linear, either saturated or unsaturated or a mixture thereof and contain 12 to 25 carbon atoms.

Particularly preferred friction modifiers are alkoxylated amines and alkoxylated ether amines, with alkoxylated amines containing about two moles of alkylene oxide per mole of nitrogen being the most preferred. Such compounds can have hydrocarbyl groups that are linear, either saturated, unsaturated or a mixture thereof. They contain 12 to 25 carbon atoms and may contain one or more hetero atoms in the hydrocarbyl chain. Ethoxylated amines and ethoxylated ether amines are especially preferred.

The amines and amides may be used as such or in the form of an adduct or reaction product with a boron compound such as a boric oxide, boron halide, metaborate, boric acid or a mono-, di- or tri-alkyl borate.

Zinc Dihydrocarbyldithiophosphate Compound

At least one zinc dihydrocarbyldithiophosphate must be added to the lubricating oil composition. Preferably zinc dialkylthiophosphate is used. This provides antioxidant and anti-wear properties to the lubricating composition. They may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: isopropanol, is-octanol, 2-butanol, methyl isobutyl carbonol (4-methyl-1-pentane-2-ol), 1-pentanol, 2-methyl butanol, and 2-methyl-1-propanol. The at least one zinc dihydrocarbyldithiophosphate compound can be a primary zinc, secondary zinc, or mixtures thereof. That is, the zinc compound contains primary and/or secondary alkyl groups. The alkyl groups can have 1 to 25 carbons, preferably 3 to 12 carbons. Moreover, there is preferably, at least about 50 mole % primary zinc from a dihydrocarbyldithiophosphate compound in the at least one zinc dihydrocarbyldithiophosphate compound.

In addition, the lubricating oil composition must have a low phosphorus content, that is the phosphorus from the zinc dihydrocarbyldithiophosphate compound should be present in an amount up to about 0.1 wt. %. Preferably, the phosphorus content from the zinc dihydrocarbyldithiophosphate should be from about 0.025 wt. % to about 0.1 wt. %.

It is also necessary that the volatility of the lubricating oil composition, as measured using the NOACK Volatility Test, be about 15 wt. % or less, such as in the range of 4 to 15 wt. %, preferably in the range of 8 to 15 wt. %. The NOACK Volatility Test is used to measure the evaporative loss of an oil after 1 hour at 250° C. according to the procedure of ASTM D5800. The evaporative loss is reported in mass percent.

The compositions can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–10 |
| Other Metal Detergents | 0.1–15 | 0.2–9 |
| Corrosion Inhibitor | 0–5 | 0–1.5 |
| Supplemental Anti-oxidant | 0–5 | 0.01–1.5 |
| Pour Point Depressant | 0.01–5 | 0.01–1.5 |
| Anti-foaming Agent | 0–5 | 0.001–0.15 |
| Supplemental Anti-wear Agents | 0–0.5 | 0–0.2 |
| Other Friction Modifiers | 0–5 | 0–1.5 |
| Viscosity Modifier | 0.01–20 | 0–15 |
| Synthetic and/or Mineral Base Stock | Balance | Balance |

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Other metal-containing or ash-forming detergents, besides the overbased magnesium or calcium detergent, may be present and these are the neutral metal detergents which function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80, but neutral phenates may have a TBN up to about 155.

Such other known detergents include oil-soluble neutral phenates, sulfonates, sulfurized phenates, thiophosphonates, and naphthenates and other oil-soluble carboxylates of a metal, particularly the alkali or alkaline earth metals, e.g., sodium, potassium, lithium, and magnesium.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and naphthylamines, phosphorus esters, metal thiocarbamates, ashless thiocarbamates and oil soluble copper compounds as described in U.S. Pat. No. 4,867,890. Most preferred are the alkyl substituted diphenylamines.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

A small amount of a demulsifying component may be used. A particularly suitable demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate of the present invention is used for blending with an oil of lubricating viscosity, the concentrate comprising: (a) at least one calcium or magnesium overbased detergent; (b) an oil soluble dimeric molybdenum compound; (c) an oil soluble organo trinuclear molybdenum compound; (d) at least one organic friction modifier; and (e) at least one zinc dihydrocarbyldithiophosphate compound, to provide a lubricating oil composition having a TBN of at least 3.6, a NOACK volatility of about 15 wt. % or less, molybdenum in an amount up to 2,000 ppm from the dimeric Mo compound and an amount up to about 350 ppm from the trinuclear molybdenum compound, and phosphorus in an amount up to about 0.1 wt. % from a zinc dihydrocarbyldithiophosphate compound.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package, with the remainder being base stock.

The eight oils shown in Table 1 were evaluated for coefficient of friction properties.

| | | (1) | (2) | (3) | (4) | (5) | (6) | (7) | (8) |
|---|---|---|---|---|---|---|---|---|---|
| Component, Wt. % | | | | | | | | | |
| (a) | Dispersant, Silicone Antifoam, Diluent Oil | 4.940 | 4.940 | 4.940 | 4.940 | 4.940 | 4.940 | 4.940 | 4.940 |
| (b) | Overbased Mg Sulfonate | 0.000 | 0.000 | 0.000 | 0.000 | 1.180 | 1.180 | 1.180 | 1.180 |
| (c) | Overbased Ca Sulfonate | 1.500 | 1.500 | 1.500 | 1.500 | 0.000 | 0.000 | 0.000 | 0.000 |
| (d) | Neutral Ca Phenate and Sulfonate | 0.800 | 0.800 | 0.800 | 0.800 | 0.800 | 0.800 | 0.800 | 0.800 |
| (e) | Amine Antioxidant | 0.500 | 0.500 | 0.500 | 0.500 | 0.500 | 0.500 | 0.500 | 0.500 |
| (f) | PIBSA | 0.250 | 0.250 | 0.250 | 0.250 | 0.250 | 0.250 | 0.250 | 0.250 |
| (g) | Mo Trimer | 0.200 | 0.200 | 0.200 | 0.200 | 0.200 | 0.200 | 0.200 | 0.200 |
| (h) | Mo Dimer | 0.000 | 0.000 | 1.600 | 1.600 | 0.000 | 0.000 | 1.600 | 1.600 |
| (i) | ZDDP | 1.160 | 1.160 | 1.160 | 1.160 | 1.160 | 1.160 | 1.160 | 1.160 |
| (j) | Polyol Ester (FM) | 0.200 | 0.000 | 0.200 | 0.000 | 0.200 | 0.000 | 0.200 | 0.000 |
| (k) | Alkoxylate Amine (FM) | 0.200 | 0.000 | 0.200 | 0.000 | 0.200 | 0.000 | 0.200 | 0.000 |
| Total (a)–(k) | | 9.75 | 9.35 | 11.35 | 10.95 | 9.43 | 9.03 | 11.03 | 10.630 |
| (l) | Base Oil | 80.40 | 80.80 | 78.80 | 79.20 | 80.72 | 81.12 | 79.12 | 79.52 |
| (m) | Lube Oil Flow Improver | 0.30 | 0.30 | 0.30 | 0.30 | 0.30 | 0.30 | 0.30 | 0.30 |
| (n) | Viscosity Modifier | 9.55 | 9.55 | 9.55 | 9.55 | 9.55 | 9.55 | 9.55 | 9.55 |
| | | 100.00 | 100.00 | 100.00 | 100.00 | 100.00 | 100.00 | 100.00 | 100.00 |
| Mo Trimer, ppm of molybdenum | | 100 ppm | 100 ppm | 100 ppm | 100 ppm | 100 ppm | 100 ppm | 100 ppm | 100 ppm |
| Mo Dimer, ppm of molybdenum | | 0 ppm | 0 ppm | 800 ppm | 800 ppm | 0 ppm | 0 ppm | 800 ppm | 800 ppm |
| Total FM (j + k) | | 0.4 | 0 | 0.4 | 0 | 0.4 | 0 | 0.4 | 0 |
| NOACK Volatility | | 11.9% | 12.0% | 12.6% | 13.2% | 12.1% | 12.1% | 12.9% | 13.3% |

Notes for Table 1

(a) The dispersant is a 54% active mineral oil solution of borated polyisobutenyl succinimide dispersant.

(b) The overbased Mg sulfonate had a TBN of 400; a 57% by weight solution in mineral oil was used.

(c) The overbased Ca sulfonate had a TBN of 300; a 55% by weight solution in mineral oil was used.

(f) "PIBSA" refers to polyisobutenyl succinic anhydride; a 72% by weight solution in mineral oil was used.

(g) "Mo trimer" is $Mo_3S_7$ $((alkyl)_2dtc)_4$ when alkyl is a cocoalkyl chain being a mixture of $C_8$–$C_{18}$ alkyls of even numbered carbons, mainly $C_{10}$, $C_{12}$ and $C_{14}$ alkyls from coconut oil and "dtc" represents dithiocarbamate.

(h) "Mo dimer" is "Molyvan 822", an oil soluble molybdenum dialkyl dithiocarbamate available from Vanderbilt Chemical (the exact length of the alkyl groups is proprietary to the manufacturer).

(i) "ZDDP" is a 50%/50% wt. mixture of zinc dialkyldithiophosphate with 85 wt. % secondary alkyl groups and 15 wt. % primary alkyl groups, and zinc dialkyldithiophosphate with 100% primary alkyl groups.

(j) and (k) are friction modifiers (FM).

(m) "LOFI" is a lube oil flow improver, a 48% solution of a dialkylfumarate-vinyl acetate copolymer.

(n) "OCP" is an olefin copolymer viscosity modifier commercially available as "Paratone 8011".

Friction measurements were made on the same eight oils using a high frequency reciprocating rig (HFRR). The disks were 650 Hv, AISI 52100 steel, polished to 0.05 micron Ra roughness.

This protocol consists of 3 separate runs at 3 constant temperatures (80, 100, 120° C.) using a new disc and ball for every run. Settings:

Load 400 gm

Frequency 20 Hz; 1 mm stroke length

Start temperature 80 (100, 120)° C.

Temperature step 0° C.

No. of steps 1

Duration 30 mins.

Strokelength 100 $\mu$m

Sampling interval 5 sec.

The results are in Tables 2 and 3; Table 3 shows a slight advantage for oils with an overbased calcium detergent.

2) 100° C. Heating—operation, speeds and load as before, but with fluid temperature is increase.

3) 150° C. Heating—same as above but at higher temperature.

4) 150° C. Aging—extended (one hour) operation at steady state only.

5) 150° C. Cooling—ramp and low speed breakaway measurements made after the Aging portion of the test.

6) 100° C. Cooling—steady state operation, ramps and low speed operation.

7) 40° C. Cooling—steady state operation, ramps and low speed operation.

TABLE 2

| Oil Number | HFFR coefficient of friction, 100° C. | Overbased Detergent | Moly timer | Moly dimer | Organic FM |
|---|---|---|---|---|---|
| 1 | 0.132 | Ca | 100 ppm | 0 ppm | 0.4 |
| 2 | 0.156 | Ca | 100 ppm | 0 ppm | 0 |
| 3 | 0.107 | Ca | 100 ppm | 800 ppm | 0.4 |
| 4 | 0.096 | Ca | 100 ppm | 800 ppm | 0 |
| 5 | 0.147 | Mg | 100 ppm | 0 ppm | 0.4 |
| 6 | 0.167 | Mg | 100 ppm | 0 ppm | 0 |
| 7 | 0.110 | Mg | 100 ppm | 800 ppm | 0.4 |
| 8 | 0.111 | Mg | 100 ppm | 800 ppm | 0 |

TABLE 3

| Oil Number | HFFR coefficient of friction, 100° C. | Overbased Detergent | Oil Number | HFFR coefficient of friction, 100° C. | Overbased Detergent | Moly trimer | Moly dimer | Organic FM |
|---|---|---|---|---|---|---|---|---|
| 1 | 0.132 | Ca | 5 | 0.147 | Mg | 100 ppm | 0 ppm | 0.4 |
| 2 | 0.156 | Ca | 6 | 0.167 | Mg | 100 ppm | 0 ppm | 0 |
| 3 | 0.107 | Ca | 7 | 0.110 | Mg | 100 ppm | 800 ppm | 0.4 |
| 4 | 0.096 | Ca | 8 | 0.111 | Mg | 100 ppm | 800 ppm | 0 |

Additional measurements of friction coefficient versus sliding speed were made using a Low Velocity Friction Apparatus (LVFA) at 150° C. for Oils 1, 2, 3 and 4 of Table 1. This technique is described in detail in references such as, "Friction of Transmission Clutch Materials as Affected by Fluids, Additives and Oxidation", Rodgers, J. J. and Haviland, M. L., Society of Automotive Engineers paper 194A, 1960 and "Prediction of Low Speed Clutch Shudder in Automatic Transmissions Using the Low Velocity Friction Apparatus", Watts, R. F. and Nibert, R. K., Engine Oils and Automotive Lubrication, Marcel Dekker, New York (1992) 732, both of which are incorporated herein by reference.

The following procedure was used to provide the results reported in Table 4:

1) 40° C. Break in—The unit is run at steady state conditions-velocity ramps and low speed breakaway measurements are also made. (Throughout the test, the machine maintains 10 kg/cm$^2$ unit pressure on the friction material. Rotational speeds targets are: steady state at 2.8 m/s, speed ramps (0-2/8-0 m/s) and low speed (.0016 m/s) breakaways.) Measurements are made of speed, load, torque and temperature throughout the test.

TABLE 4

| | Oil 1 | Oil 2 | Oil 3 | Oil 4 |
|---|---|---|---|---|
| Overbased Detergent | Ca | Ca | Ca | Ca |
| Moly trimer | 100 ppm | 100 ppm | 100 ppm | 100 ppm |
| Moly dimer | 0 ppm | 0 ppm | 800 ppm | 800 ppm |
| Organic FM | 0.4 | 0 | 0.4 | 0 |
| Speed (m/s) | | | | |
| 0.01 | 0.062 | 0.08 | 0.06 | 0.091 |
| 0.01 | 0.07 | 0.093 | 0.07 | 0.106 |
| 0.02 | 0.082 | 0.11 | 0.083 | 0.125 |
| 0.03 | 0.088 | 0.122 | 0.089 | 0.134 |
| 0.04 | 0.089 | 0.124 | 0.089 | 0.136 |
| 0.05 | 0.09 | 0.124 | 0.09 | 0.136 |
| 0.06 | 0.091 | 0.125 | 0.091 | 0.137 |
| 0.07 | 0.093 | 0.127 | 0.093 | 0.139 |
| 0.08 | 0.095 | 0.128 | 0.095 | 0.14 |
| 0.09 | 0.096 | 0.129 | 0.096 | 0.141 |
| 0.1 | 0.097 | 0.13 | 0.098 | 0.142 |
| 0.15 | 0.102 | 0.132 | 0.102 | 0.144 |
| 0.2 | 0.105 | 0.133 | 0.105 | 0.145 |
| 0.25 | 0.108 | 0.133 | 0.107 | 0.145 |
| 0.3 | 0.11 | 0.134 | 0.109 | 0.145 |
| 0.4 | 0.113 | 0.134 | 0.112 | 0.145 |
| 0.5 | 0.115 | 0.134 | 0.114 | 0.144 |
| 0.6 | 0.116 | 0.133 | 0.116 | 0.143 |
| 0.7 | 0.117 | 0.133 | 0.117 | 0.142 |
| 0.8 | 0.118 | 0.132 | 0.118 | 0.14 |

TABLE 4-continued

| | Oil 1 | Oil 2 | Oil 3 | Oil 4 |
|---|---|---|---|---|
| 0.9 | 0.119 | 0.131 | 0.119 | 0.139 |
| 1 | 0.12 | 0.13 | 0.119 | 0.138 |

These data show the consequently superior results for Oil 3 which contained both the molybdenum trimeric and dimeric compound as well as the friction modifier. The data shows coefficient of friction versus sliding speed using "SD 1777" (Borg-Warner, paper friction material) clutch plate material. This data shows that the oils of this invention have superior wet clutch friction performance when used as a universal lubricating oil, such as a universal tractor fluid.

What is claimed is:

1. A lubricating oil composition which exhibits improved fuel economy and wet clutch friction properties, said composition comprising:

a) an oil of lubricating viscosity;

b) at least one overbased calcium or magnesium detergent;

c) an oil soluble dimeric molybdenum compound present in such amount so as to provide up to 2,000 ppm Mo in the composition;

d) an oil soluble trinuclear molybdenum compound present in such amount so as to provide up to 350 ppm Mo in the composition;

e) at least one organic oil soluble friction modifier; and f) at least one zinc dihydrocarbyldithiophosphate compound, wherein said composition has a TBN of at least 3.6 attributable to said overbased calcium or magnesium detergent, a NOACK volatility of about 15 wt. % or less and phosphorus in an amount up to about 0.1 wt. % from the zinc dihydrocarbyldithiophosphate compound.

2. The composition according to claim 1 wherein said overbased calcium or magnesium detergent is selected from the group consisting of calcium and magnesium phenates, salicylates, sulfonates and mixtures thereof.

3. The composition according to claim 1 wherein said overbased detergent is an overbased calcium or magnesium sulfonate.

4. The composition according to claim 3 wherein said overbased detergent is a calcium sulfonate which has a total base number of from 250 to 450.

5. The composition according to claim 1 wherein said molybdenum from the trinuclear molybdenum compound is present in an amount of about 10 ppm to 350 ppm.

6. The composition according to claim 5 wherein said molybdenum from the dimeric molybdenum compound is present in an amount of about 400 ppm to 2,000 ppm.

7. The composition according to claim 1 wherein said molybdenum dimeric or trinuclear compound is selected from the group consisting of: a molybdenum dialkyldithiocarbamate, molybdenum dialkyldithiophosphate, molybdenum dialkyldithiophosphinate, molybdenum xanthate, molybdenum thioxanthate, and mixtures thereof.

8. The composition according to claim 7 wherein said molybdenum dimeric or trinuclear compound is present as molybdenum dialkyldithiocarbamate.

9. The composition according to claim 1 wherein said molybdenum dimeric or trinuclear compound is a molybdenum/sulfur complex of a basic nitrogen compound.

10. The composition according to claim 1 wherein said zinc dihydrocarbyldithiophosphate compound comprises zinc from a primary alkyl group, secondary alkyl group, or mixtures thereof.

11. The composition according to claim 10 wherein said zinc dihydrocarbyldithiophosphate compound comprises at least about 50 mole % primary zinc from a dihydrocarbyldithiophosphate compound.

12. The composition according to claim 1 wherein said the friction modifier is an ethoxylated amine.

13. The composition according to claim 1 wherein said phosphorus content is about 0.025 wt. % to 0.1 wt. %.

14. A method for improving the fuel economy properties of an internal combustion engine, which comprises: (1) adding to said engine the lubricating oil composition of claim 1; and (2) operating said engine.

15. A concentrate for blending with an oil of lubricating viscosity, said concentrate comprising:

a) at least one overbased calcium or magnesium detergent;

b) an oil soluble dimeric molybdenum compound and an oil soluble organo trinuclear molybdenum compound;

c) at least one organic oil soluble friction modifier; and d) at least zinc dihydrocarbyldithiophosphate compound, to provide a lubricating oil composition having a TBN of at least 3.6 attributable to said overbased calcium or magnesium, a NOACK volatility of about 15 wt. % or less molybdenum in an amount up to 2000 ppm from the dimeric molybdenum compound, molybdenum in an amount up to about 350 ppm from the trinuclear molybdenum compound, and phosphorus in an amount up to about 0.1 wt. % from the zinc dihydrocarbyldithiophosphate compound.

* * * * *